United States Patent [19]

Tallent et al.

[11] Patent Number: 4,905,996

[45] Date of Patent: Mar. 6, 1990

[54] BALL AND TARGET NET APPARATUS

[76] Inventors: David P. Tallent; Christopher D. Tallent, both of Rte. 2, Box 348, Spring City, Tenn. 37381

[21] Appl. No.: 330,209

[22] Filed: Mar. 29, 1989

[51] Int. Cl.[4] ..... A63B 69/00

[52] U.S. Cl. ..... 273/26 A; 273/181 A; 273/401; 273/410; 273/29 A

[58] Field of Search ..... 273/26 A, 401, 29 A, 273/402, 403, 404, 410, 181 A, 181 F, 29 A

[56] References Cited

U.S. PATENT DOCUMENTS

| | | | |
|---|---|---|---|
| 3,195,898 | 7/1965 | Respini | 273/26 A |
| 3,197,208 | 7/1965 | Makar | 273/26 A |
| 3,929,334 | 12/1975 | Magazzu | 272/26 A |
| 3,986,719 | 10/1976 | Lee | 273/181 F |
| 4,068,846 | 1/1978 | Phelps | 273/181 A |
| 4,083,559 | 4/1978 | Owen, Jr. | 273/26 A |
| 4,497,485 | 2/1985 | Macosko | 273/401 |
| 4,643,423 | 2/1987 | Wright | 273/26 A |

*Primary Examiner*—T. Brown

*Attorney, Agent, or Firm*—Leon Gilden

[57] ABSTRACT

A ball and target net game apparatus is set forth wherein a target net includes a perimeter framework securing a generally planar net wherein the frame work includes a plurality of forwardly extending horizontal legs and associated bracing to maintain the netting in a secure arrangement in use. The framework and the legs of the apparatus are telescoping to effect a compact structure easily stored when not in use. An inner net is selectively securable to spaced elongate straps longitudinally secured relative to the main net portion of the apparatus to provide a target in variable orientation relative to the main net.

7 Claims, 1 Drawing Sheet

BALL AND TARGET NET APPARATUS

BACKGROUND OF THE INVENTION

1. Field of the Invention

The field of invention relates to ball and backstop arrangements, and more particularly pertains to a new and improved ball and target net game wherein the same may be compactly stored when not in use and extended to present a backstop and variably target net to effect a target in the playing of the game.

2. Description of the Prior Art

The use of net backstops for stopping the flight of a ball thrown thereto is well known in the prior art. Typically these devices have been of singular purpose limiting their application as an amusement and entertainment device. Examples of prior art backstops in ball hurdling games may be found in U.S. Pat. No. 3,195,898 to Respini wherein a framework supports a net provided with a bulls-eye type target and the framework may be staked into the ground to provide a suitable stopping arrangement.

U.S. Pat. No. 3,197,208 to Makar sets forth a similar bulls-eye target arranged somewhat medially of a "U" shaped net arrangement wherein the "U" shaped net arrangement ostensibly assists in preventing passage of a ball hurdled or thrown at the net.

U.S. Pat. No. 3,929,334 to Magazzu sets forth a vertically suspended loop with a net depending downwardly therefrom to serve as a predetermined target in a pitching arrangement, as may be practiced in the game of baseball.

U.S. Pat. No. 3,986,719 to Lee sets forth a golf net target wherein a framework secures a net suspended from a horizontal uppermost bar to stop a golf ball targeted at the net wherein the perimeter framework is supported upon a plurality of forwardly oriented legs with curvilinear rear end sections to enable the apparatus to rock and return to a vertical position when struck by a golf ball.

U.S. Pat. No. 4,643,423 to Wright sets forth a pitching target game wherein a net is provided in a suspended relationship from a framework and wherein a trough is positioned underlying the net to catch and receive balls impacting on the net.

As such, it may be appreciated that there is continuing need for a new and improved ball and target net game that addresses both the problem of compactness and versatility in use, and the present invention substantially fulfills this need.

SUMMARY OF THE INVENTION

In view of the foregoing disadvantages inherent in the known types of target net devices now present in the prior art, the present invention provides a ball and target net game wherein the same may be compactly stored when not in use and may be telescopingly erected to support a main net with a target supported forwardly of the main net. As such, the general purpose of the present invention, which will be described subsequently in greater detail, is to provide a new and improved ball and target net arrangement which has all the advantages of the prior art target nets and none of the disadvantages.

To attain this, the present invention comprises a generally rectangular perimeter framework with telescoping vertical legs with rearwardly extending legs also telescopingly arranged to collapse whereby the apparatus may be interfolded to effect a generally plate-like storage portion. A target net is selectively securable onto spaced lonitudinal straps forwardly and selectively of the main net surface by using hook and loop fasteners to secure the target net to the straps.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ball and target net apparatus which has all the advantages of the prior art target games and none of the disadvantages.

It is another object of the present invention to provide a new and improved ball and target net apparatus which may be easily and efficiently manufactured and marketed.

It is a further object of the present invention to provide a new and improved ball and target net apparatus which is of a durable and reliable construction.

An even further object of the present invention is to provide a new and improved ball and target net apparatus which is susceptible of a low cost of manufacture with regard to both materials and labor, and which accordingly is then susceptible of low prices of sale to the consuming public, thereby making such ball and target net apparatus economically available to the buying public.

Still yet another object of the present invention is to provide a new and improved ball and target net apparatus which provides in the apparatuses and methods of the prior art some of the advantages thereof, while simultaneously overcoming some of the disadvantages normally associated therewith.

Still another object of the present invention is to provide a new and improved ball and target net apparatus wherein the same is provided with a selectively positionable target net forwardly of the surface of a main net.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic view of a top portion of a strap member of FIG. 3.

DESCRIPTION OF THE PREFERRED EMBODIMENT

Figure 1:
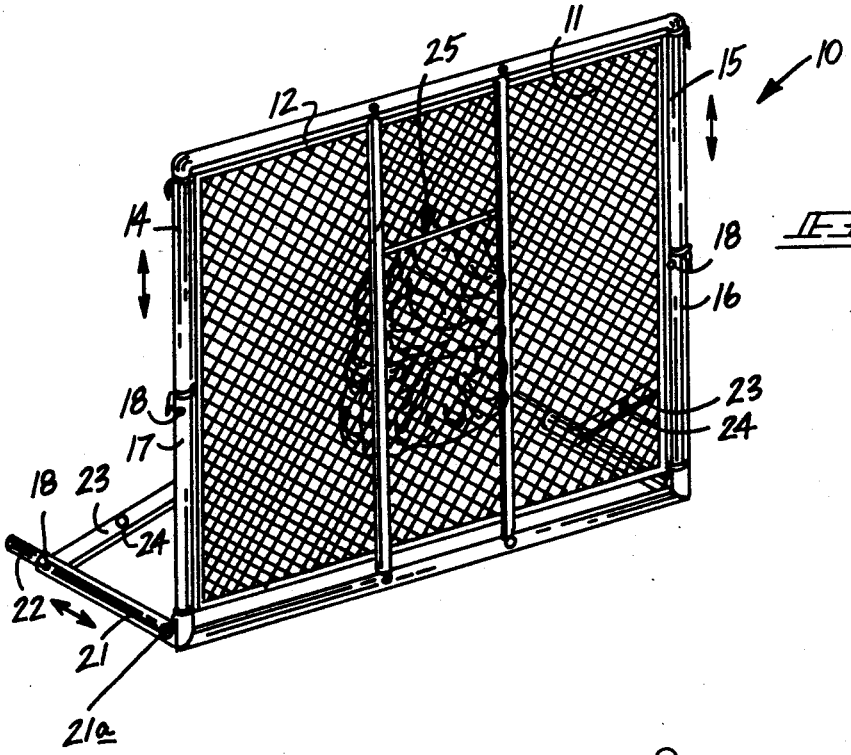
FIG. 1 is an isometric illustration of the instant invention.
Figure 2:
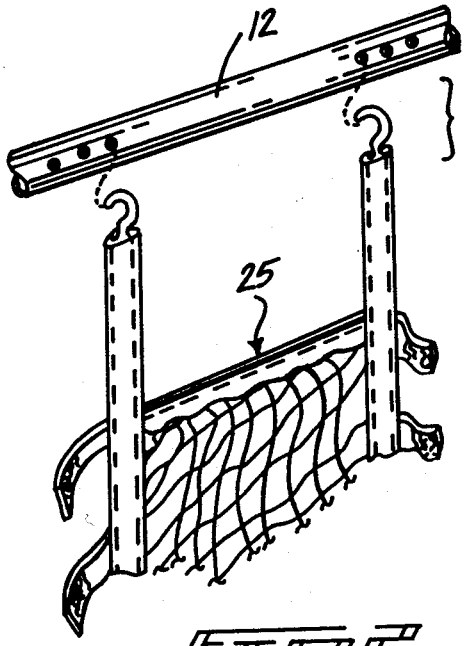
FIG. 2 is an isometric illustration of the target net associated with the straps of the instant invention.
Figure 3:
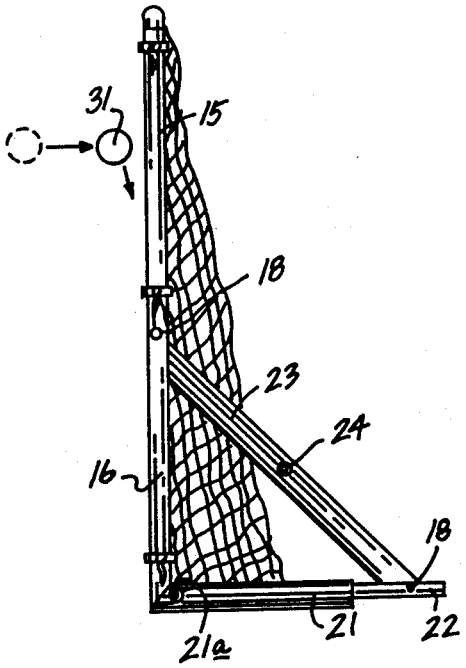
FIG. 3 is an orthographic side view of the instant invention taken in elevation.

With reference now to the drawings, and in particular to FIGS. 1 to 4 thereof, a new and improved ball and target net apparatus embodying the principles and concepts of the present invention and generally designated by the reference numeral 10 will be described.

More specifically, the ball and target net apparatus of the instant invention essentially comprises a loosely supported main net 11 secured to a top horizontal frame member 12 and a bottom horizontal frame member 13, each containing a series of vertically aligned apertures 12*a* and 13*a* respectively. The top horizontal frame member is secured to right and left reciprocating vertical legs 14 and 15 respectively wherein the bottom horizontal frame member is secured to right and left receiving vertical legs 16 and 17 respectively wherein the right and left vertical legs 14 and 15 are telescopingly receivable within a respective right and left vertical leg 16 and 17 and may be secured in an extended position by conventional detent spring buttons 18 of well known construction to maintain the legs in an extended orientation relative to one another. Similarly, a plurality of first horizontal leg members 21 fixed relative to the lower terminal ends and orthogonally thereto of the right and left vertical legs 16 and 17 telescopingly receive second horizontal leg members 22, also secured by spring biased detent buttons 18.

The vertical and horizontal receiving legs are each joined by a diagonal brace 23 formed with a central lock pivot 24 that enables the interfolding of the apparatus with the horizontal legs 21 receiving the second horizontal legs 22 and pivotal to a vertical position adjacent the respective right and left vertical legs 16 and 17 when the horizontal legs 21 are pivoted about respective pivots 21*a* pivotally mounting respective forward ends of the legs 21 to the associated vertical legs 16 and 17

A target net 25 defining a pouch 25*a* is securable forwardly and selectively about the main net 11 as desired and is preferably formed of a different and contrasting coloration netting relative to the main net 11 to enhance visual contrast during use. The target net 25 is formed with a series of hook and loop fastening straps 26 along the sides of the target net 25. Each of the fastening straps 26 are selectively securable to spaced first and second flexible longitudinal straps 19 and 20. The rear surfaces in confronting relationship to the main net 11 include a coextensive complementary hook and loop fastening surface to enable engagement of the strap 26 as desired along the length of the straps 19 and 20. FIG. 4 is illustrative of a complementary hook and loop surface 19*a*. Strap 20 is similarly arranged with a coextensive hook and loop fastening surface. Extending outwardly of each end of the straps 19 and 20 are upper and lower securement hooks 27 and 28 respectively to respectively engage upper and lower apertures 12*a* and 13*a*. Accordingly, it may be appreciated that the target net is vertically positionable relative to the main net 11 by adjustably securing the target net relative to straps 19 and 20. The target net is further horizontally adjustable relative to the main net 11 with securement of straps 19 and 20 within selective apertures 12*a* and 13*a*. It is to be understood the straps 19 and 20 are spaced apart a distance equal to the width of target net 25.

In this manner, the ball and target net apparatus of the instant invention sets forth a variety of uses of the game by use of a ball entrapping loosely supported main net 11 by itself, and by use of the net 11 in association with the target net 25.

The manner of usage and operation therefore of the instant invention should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A ball and target net apparatus comprising a main webbed net defining a perimeter wherein said upper perimeter of said net is secured to a top elongate frame member, and a lower perimeter of said net is secured to a lower elongate horizontal frame member said main net being loosely suspended by said top, lower and vertical frame members, and said top frame member is fixedly secured at its ends to upper vertical leg portions, and said lower horizontal frame member is secured at its ends to bottom vertical leg portions, and said upper vertical leg portions are telescopingly receivable within said lower vertical leg portions, and a foldable brace member secures each bottom vertical leg portion to a rearwardly extending leg member, and each leg member being pivotally mounted at its forward end to a respective bottom vertical leg portion, a pair of spaced apart horizontally adjustable vertical straps, each strap having hook and loop fasteners along its length and being supported by said top and lower frame members forward of said main net, and a target net having hook and loop fastening straps about its periphery connected to said vertical hook and loop straps selectively securable forwardly of the main net said target net being horizontally and vertically adjustable relative to said main net.

2. A ball and target net apparatus as set forth in claim 1 wherein each of said brace members are formed with a pivot hinge medially thereof.

3. A ball and target net apparatus as set forth in claim 2 wherein each rearwardly extending leg member telescopingly receives a further rearwardly extending leg member telescoping received within each rearwardly extending leg member.

4. A ball and target net apparatus as set forth in claim 3 wherein the top elongate frame member includes a series of apertures therethrough and the lower elongate horizontal frame member includes a further series of apertures therethrough, each aperture in said top frame member being vertically aligned with a respective aperture in said lower frame member.

5. A ball and target net apparatus as set forth in claim 4 wherein each of said vertical straps including a hook member attached to its upper and lower ends, each hook being inserted into one of said apertures of respective top and lower elongate horizontal frame members.

6. A ball and target net apparatus as set forth in claim 5 wherein each of said vertical straps is flexible and includes said hook and loop fasteners coextensive with a rear surface of each strap, wherein each rear surface of each strap is in confronting relationship to the main net when the strap is secured forwardly of the main net to the top and lower horizontal frame members.

7. A ball and target net apparatus as set forth in claim 6 wherein said hook and loop fastening straps of said target net are secured to the rear surface of said vertical straps said target net being in the form of a pouch for retaining balls thrown or hit therein.

* * * * *